US006669015B2

(12) United States Patent
Draghetti et al.

(10) Patent No.: US 6,669,015 B2
(45) Date of Patent: Dec. 30, 2003

(54) PACKET OF CIGARETTES AND RELATIVE PRODUCTION METHOD

(75) Inventors: Fiorenzo Draghetti, Medicina (IT); Angelo Li Vigni, Bologna (IT)

(73) Assignee: G.D Societa' per Azioni, Bologna (IT)

( * ) Notice: Subject to any disclaimer, the term of this patent is extended or adjusted under 35 U.S.C. 154(b) by 0 days.

(21) Appl. No.: 10/219,838

(22) Filed: Aug. 15, 2002

(65) Prior Publication Data

US 2003/0052020 A1 Mar. 20, 2003

Related U.S. Application Data

(63) Continuation of application No. PCT/IT01/00073, filed on Feb. 16, 2001.

(30) Foreign Application Priority Data

Feb. 16, 2000 (IT) ..... BO2000A0067

(51) Int. Cl.[7] ..... B65D 85/10

(52) U.S. Cl. ..... 206/271; 53/415; 206/459.5; 206/818

(58) Field of Search ..... 53/415; 206/242, 206/245, 268, 271, 273, 459.1, 459.5, 818; 340/572.6

(56) References Cited

U.S. PATENT DOCUMENTS

| | | | | |
|---|---|---|---|---|
| 4,651,877 A | * | 3/1987 | Adrianuus De Mooy | 206/459.5 |
| 4,836,378 A | * | 6/1989 | Lephardt | 206/459.5 |
| 6,209,290 B1 | * | 4/2001 | Boriani et al. | 53/415 |
| 6,216,860 B1 | * | 4/2001 | Boriani et al. | 206/268 |
| 2003/0038044 A1 | * | 2/2003 | Draghetti | 206/273 |
| 2003/0047469 A1 | * | 3/2003 | Draghetti et al. | 206/245 |

FOREIGN PATENT DOCUMENTS

| | | |
|---|---|---|
| DE | 35 22 614 | 1/1987 |
| DE | 299 20 743 | 1/2000 |
| DE | 100 47 447 | 5/2001 |
| EP | 0 317 202 | 5/1989 |
| EP | 0 900 646 | 3/1999 |
| FR | 2 700 617 | 7/1994 |
| FR | 2 711 825 | 5/1995 |
| GB | 838385 | 6/1960 |

* cited by examiner

*Primary Examiner*—Jim Foster
(74) *Attorney, Agent, or Firm*—Marshall, Gerstein & Borun LLP

(57) ABSTRACT

A packet (2) of cigarettes and relative production method, wherein a label (7), defined at least partly by a portion (8) of magnetic tape, is applied to a component (3*a*, 16, 20) of the packet (2) so as to be visible on the outside of the finished packet (2); the label (7) being printed, on the machine and by means of a printing device (34), with data relating to the packet (2).

13 Claims, 3 Drawing Sheets

PACKET OF CIGARETTES AND RELATIVE PRODUCTION METHOD

CROSS REFERENCE TO RELATED APPLICATION

This application is a continuation of international application PCT/IT01/00073, filed Feb. 16, 2001, pending.

TECHNICAL FIELD

The present invention relates to a packet of, cigarettes.

In particular, the present invention relates to a parallelepiped-shaped packet of cigarettes comprising an outer package normally formed by folding sheet material, and an inner wrapping of foil or paper wrapped about a group of cigarettes.

Here and hereinafter, the term "outer package" is used to indicate an outer wrapping normally formed from a sheet of paper or from a blank of cardboard or similar; or an overwrapping formed from a sheet of transparent material; or the above outer wrapping and overwrapping combined.

BACKGROUND ART

Patent EP 317,202 discloses a novel tear strip or sealing strip for a package of cigarettes; the tear strip or sealing strip comprises a plastic film substrate upon which a magnetizable metal oxide coating has been deposited. The coated strip may be adhered to the package or the flexible wrapping material for the package or container, optionally, the strip may be coated with a pigment or metallized or printed with graphic indicia or any combination of these features. Information may be recorded on the magnetic coating during packaging and handling for subsequent readout.

In other words, patent EP 317,202 discloses a packet provided with a portion of magnetic tape visible from the outside, and on which is recorded data unequivocally identifying the packet; the portion of magnetic tape constitutes for the packet, among other things, a certificate of origin making any attempt to counterfeit the packet extremely complicated and expensive.

To produce such a packet, packing machines are provided with a line for supplying a prerecorded magnetic tape, from which portions containing the data relative to the packets are cut off successively.

Together with the data recorded on the respective portion of magnetic tape, it is often desirable to also provide each packet with data of interest, not so much to the maker or retailer, as to the consumer, such as the date of manufacture and, more importantly, a possible sell-by date.

Obviously, consumer-directed data cannot be recorded magnetically on the magnetic tape, by requiring special reading devices for it to be read; and neither can it be prerecorded, since information such as the sell-by date of the packet can only be applied to the packet when it is actually produced.

Patent EP 317,303 discloses to optionally printing the tear/sealing strip with graphic indicia; however, the dimensions and the location of the tear/-sealing strip does not allow giving to the consumer the desired information.

DISCLOSURE OF INVENTION

It is an object of the present invention to provide a packet of cigarettes designed to provide consumers with all necessary information in clear text, in a low-cost manner and with substantially no alterations to existing packing machines.

According to the present invention, there is provided a packet of cigarettes having a parallelepiped shape and comprising a number of sheet material packing components folded and assembled to one another to define an inner wrapping housing a group of cigarettes and an outer package; the packet having two lateral major walls and two lateral minor walls and comprising a top portion, which is openable for the extraction of the cigarettes, and a bottom portion for the storage of the cigarettes; and a label being applied to at least one of said packing components and being visible on the outside of the packet; characterized in that at least one portion of the label is defined by a portion of magnetic data recording tape, the label has printed graphic signs, and the label is applied to one of said lateral walls of said bottom portion of the packet in order to be completely arranged on only one lateral wall of said bottom portion.

The present invention also relates to a method of producing a packet of cigarettes.

According to the present invention, there is provided a method of producing a packet of cigarettes having a parallelepiped shape, the method comprising the first steps of folding and assembling to one another a number of sheet material components to define an inner wrapping housing a group of cigarettes and an outer package; and a second step of supplying and applying a label to at least one of said components, so that the label is visible on the outside of the said packet; the packet having two lateral major walls and two lateral minor walls and comprising a top portion, which is openable for the extraction of the cigarettes, and a bottom portion; said label being at least partly defined by a portion of magnetic data recording tape; and the method being characterized by comprising the further step of printing graphic signs on said label during or after said second step; the label being applied to said bottom portion of the packet and to one of said lateral walls in order to be completely arranged on only one lateral wall.

BRIEF DESCRIPTION OF THE DRAWINGS

A number of non-limiting embodiments of the present invention will be described by way of example with reference to the accompanying drawings, in which.

BEST MODE FOR CARRYING OUT THE INVENTION

Figure 1:
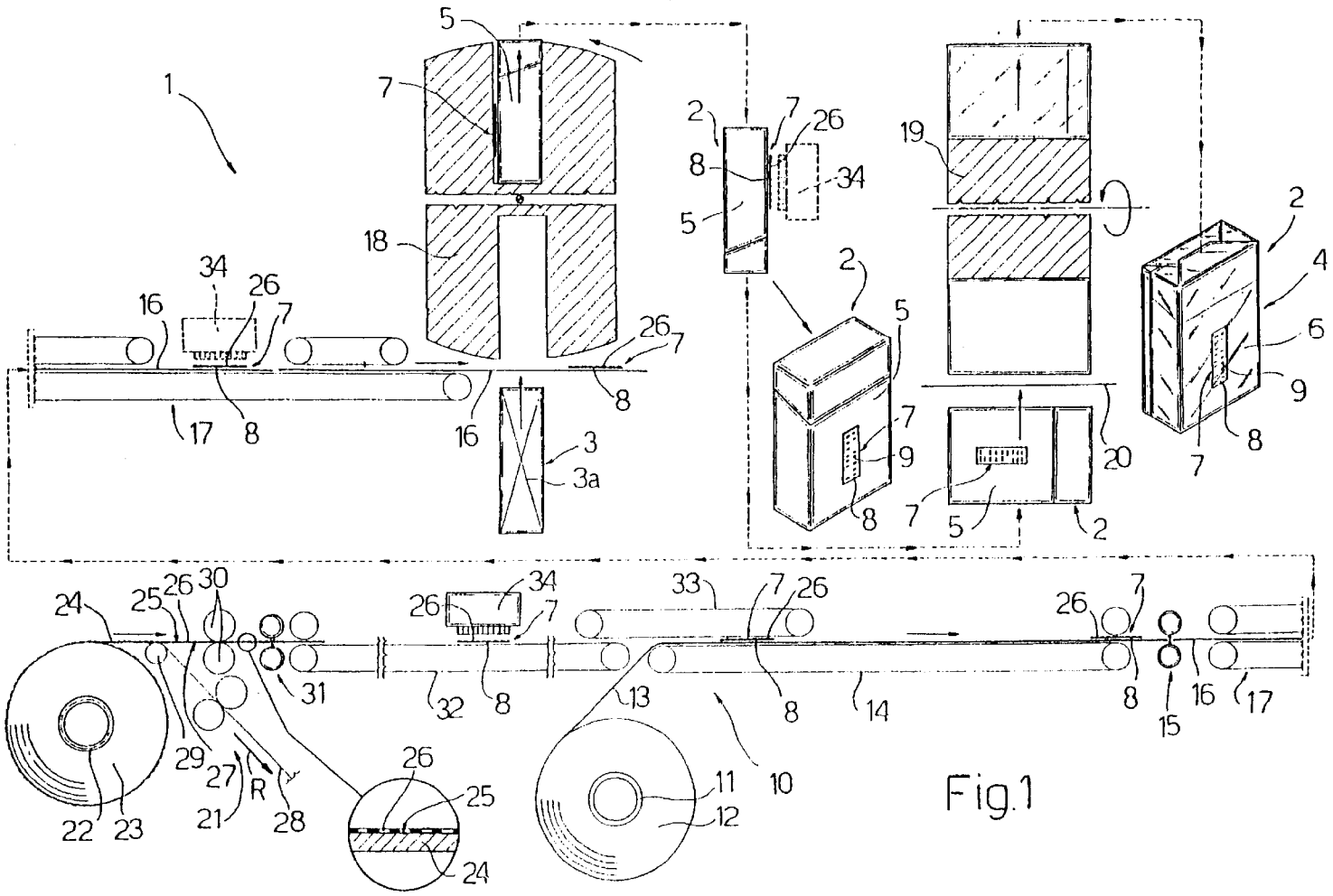
FIG. 1 shows a schematic view in perspective, partly in block form, of a portion of a production line of a machine for producing a first embodiment of the packet according to the present invention.

Number 1 in FIG. 1 indicates as a whole a line for producing packets 2, each of which is substantially parallelepiped-shaped and houses a group of cigarettes (not shown) enclosed in an inner wrapping 3 made by folding a sheet 3*a* of foil in known manner.

Each packet 2 comprises an outer package 4, which, in the example shown, comprises an outer wrapping 5 about inner wrapping 3, and an overwrapping 6 of transparent material—in the example shown, polypropylene—covering outer wrapping 5.

Packet 2 also comprises a label 7 defined by a portion 8 of magnetic data recording tape, which, in the specific example shown, is connected to outer wrapping 5 and has graphic signs 9 visible on the outside of packet 2 and containing, for example, the date of manufacture of packet 2.

In variations not shown, label 7 is connected to overwrapping 6, or—in the event packet 2 is a so-called "soft" pack, in which part of inner wrapping 3 is visible on the outside—is connected astride outer wrapping 5 and inner wrapping 3.

Line 1 comprises a known supply line 10 in turn comprising a support 11 for a reel 12, from which a continuous strip 13 of sheet material is unwound and fed by a conveyor 14 to a cutting station 15 where strip 13 is converted into a succession of sheets 16 of packing material.

In a variation not shown, line 10 is replaced by a known line (not shown) for supplying precut sheets 16 of packing material defined, for example, by blanks.

Each sheet 16 of packing material is fed by a conveyor 17 to the input of a known packing wheel 18 forming part of line 1, and by which sheet 16 of packing material is folded about a respective inner wrapping 3 to form respective outer wrapping 5.

On a known cellophaning machine 19 downstream from packing wheel 18 and forming part of line 1, outer wrapping 5 is then covered with a sheet 20 of transparent overwrapping material, which is folded in known manner about outer wrapping 5 to form overwrapping 6 and so complete outer package 4.

Line 1 also comprises a line 21 for supplying portions 8, and which in turn comprises a support 22 for a reel 23, from which is unwound a continuous magnetic tape 24, one surface 25 of which is coated, in the example shown, with an optional layer 26 of lacquer. On the opposite side to surface 25, tape 24 has a surface 27, which is cold gummed and protected by a nonstick strip 28, which is unwound together with tape 24 and guided by a guide roller 29 along a collecting path R.

Tape 24 is fed by two rollers 30 to a cutting station 31 where it is cut into a succession of portions 8. Portions 8 so formed are then fed onto a conveyor 32—preferably a nonstick suction conveyor—by which they are accelerated to separate them by a distance equal to the length of a sheet 16 of packing material before being fed by a conveyor 33 onto the outer surface of strip 13 on conveyor 14. Strip 13, together with portions 8, is then fed by conveyor 14 through cutting station 15, and the resulting sheets 16 of packing material are fed by conveyor 17 onto packing wheel 18.

Along line 1 and upstream from conveyor 33, there is provided a printing device 34—optical, ink-jet or other type—for printing graphic signs 9 on surface 25 of each portion 8.

As shown in the variations indicated by the dash lines in FIG. 1, printing device 34 may be located anywhere along line 1 permitting on-line printing of graphic signs 9 on portions 8.

Figures 2, 3:
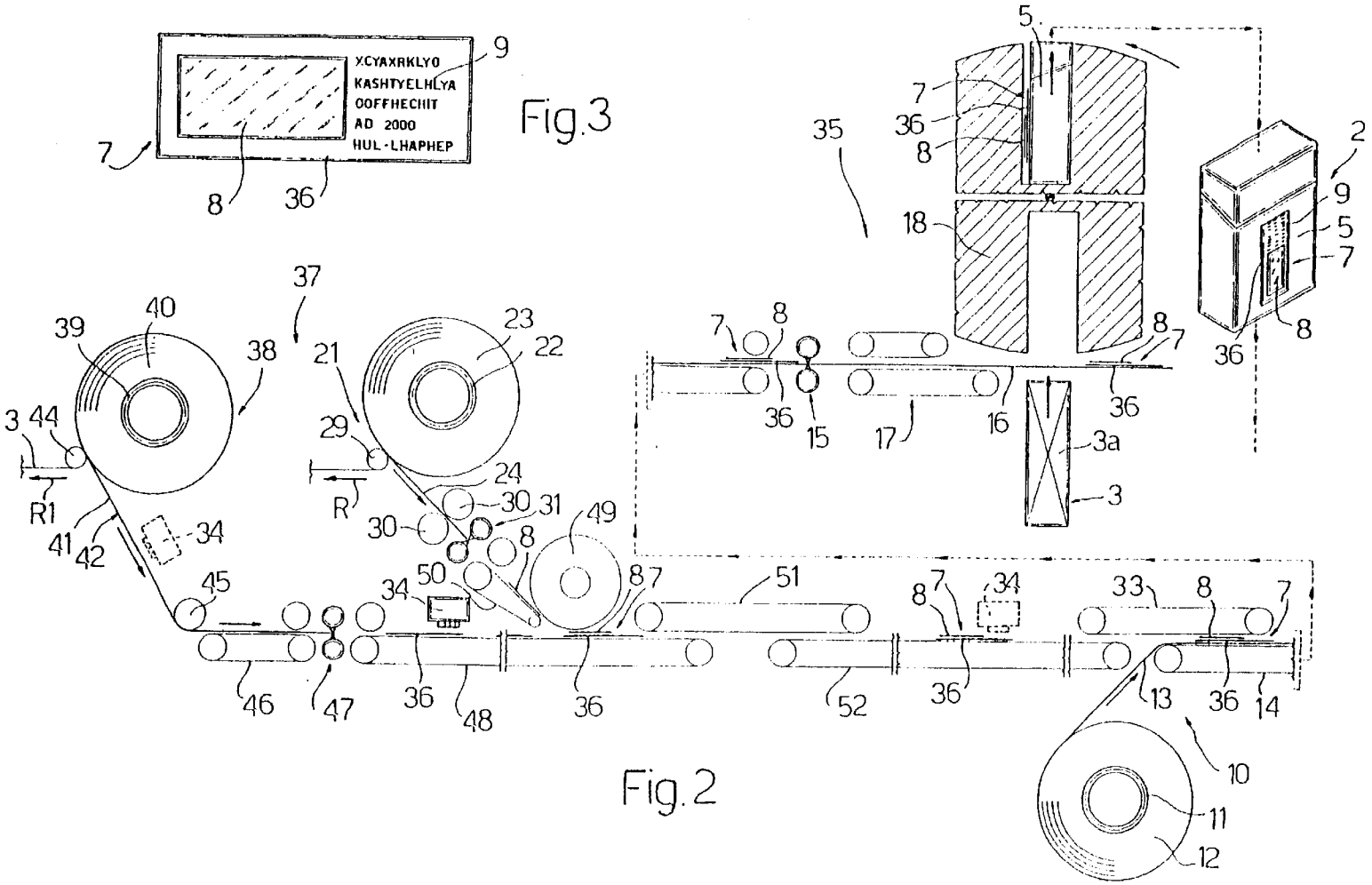
FIG. 2 shows a schematic view in perspective, partly in block form, of a portion of a production line of a machine for producing a second embodiment of the packet according to the present invention.
FIG. 3 shows a larger-scale view of a detail of the second embodiment of the packet according to the present invention.

As an alternative to line 1, FIG. 2 shows a production line 35, the parts of which are indicated, wherever possible, using the same reference numbers as for the corresponding parts of line 1.

Line 35 produces a succession of packets 2, each having a label 7, which is integral with outer wrapping 5 and, as shown more clearly in FIG. 3, is defined by a rectangular portion 36 of paper to which is connected a rectangular magnetic portion 8 smaller than portion 36. The part of portion 36 not occupied by portion 8 comprises a portion bearing graphic signs 9, which are printed on portion 36 by printing device 34.

Line 35 is similar to line 1, except that line 21 supplying portions 8 on line 1 is replaced by a line 37, which, in addition to line 21, also comprises a further line 38 located upstream from line 21 and for supplying portions 36.

Line 38 comprises a support 39 for a reel 40, from which is unwound a continuous strip 41 of paper material, one surface 42 of which is cold gummed and protected by a nonstick strip 43, which is unwound together with strip 41 and guided by a guide roller 44 along a collecting path R1.

Continuous strip 41 is guided by a roller 45 onto a conveyor 46—preferably a nonstick suction conveyor—by which continuous strip 41 is fed through a cutting station 47 to obtain a continuous succession of portions 36. Portions 36 are transferred to a conveyor 48, by which they are accelerated and spaced a given distance apart. And to each portion 36 is applied a respective portion 8, which, at the output of line 21, is accelerated by a conveyor 50 and applied to respective portion 36 by a roller 49.

Each label 7 so formed is transferred by a conveyor 51 to a conveyor 52, by which it is accelerated and separated from the adjacent labels 7 by a distance equal to the length of a sheet 16 of packing material, before being fed by conveyor 33 to the input of line 10.

Figure 4:
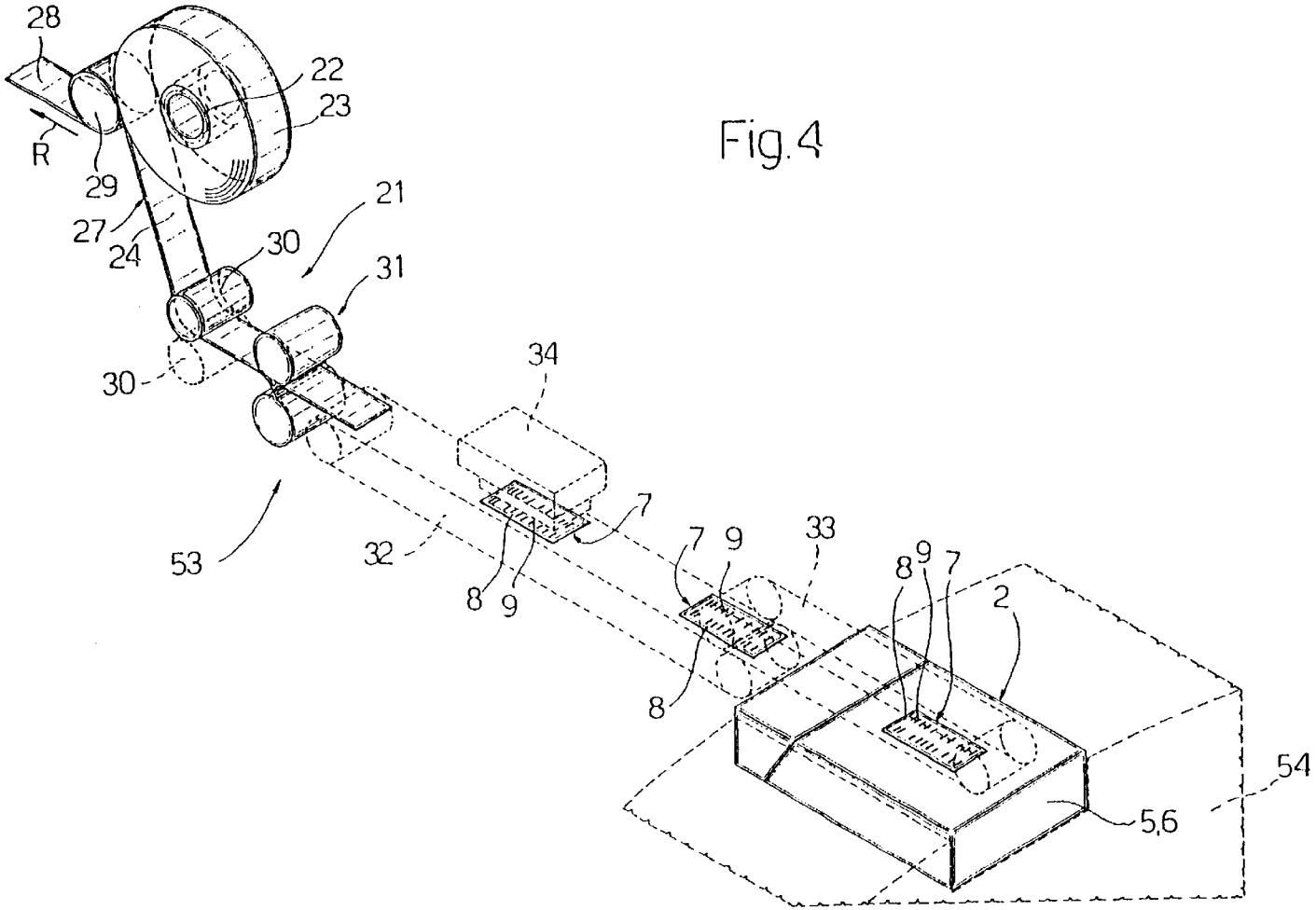
FIG. 4 shows a schematic view in perspective, partly in block form, of a variation of the FIG. 1 production line.

FIG. 4 shows a production line 53 similar to line 1, except that, as opposed to being arranged in series, lines 10 and 21 may be arranged parallel. More specifically, on line 53, line 10 (not shown in FIG. 4) supplies sheets 16 of packing material (not shown in FIG. 4) to packing wheel 18 (not shown in FIG. 4), which forms and supplies outer wrappings 5 to cellophaning machine 19 (not shown in FIG. 4) to form overwrappings 6 and so complete outer packages 4. As packets 2 are conveyed on a conveying wheel 54 upstream or downstream from cellophaning machine 19, a label 7, fed onto wheel 54 by line 21 and conveyor 33, is applied to overwrapping 6 or to the outer surface of outer wrapping 5 of each packet 2.

In a variation not shown, line 21 of production line 53 is replaced by a line 37.

In a further variation not shown, tape 24 of line 21 is lacquered on the machine by a lacquering device (not shown) downstream from reel 23.

What is claimed is:

1. A packet of cigarettes having a parallelepiped shape and comprising a number of sheet material packing components (3*a*, 16, 20) folded and assembled to one another to define an inner wrapping (3) housing a group of cigarettes and an outer package (4); the packet (2) having two lateral major walls and two lateral minor walls and comprising a top portion, which is openable for the extraction of the cigarettes, and a bottom portion for the storage of the cigarettes; and a label (7) being applied to at least one of said packing components (3*a*, 16, 20) and being visible on the outside of the packet (2); characterized in that at least one portion of the label (7) is defined by a portion (8) of magnetic data recording tape, the label (7) has printed graphic signs (9), and the label (7) is applied to one of said lateral walls of said bottom portion of the packet in order to be completely arranged on only one lateral wall of said bottom portion.

2. The packet of claim 1 wherein said outer package (4) comprises an outer wrapping (5); said label (7) being applied to an outer surface of said outer wrapping (5).

3. The packet of claim 1 wherein said outer package (4) comprises an outer wrapping (5), and an overwrapping (6) of transparent material covering said outer wrapping (5); said label (7) being applied to said overwrapping (6).

4. The packet of claim 1 said label (7) is defined entirely by a portion (8) of magnetic tape.

5. The packet of claim 1 wherein said graphic signs (9) are printed on a portion (8) of magnetic tape.

6. The packet of claim 5 wherein said portion (8) of magnetic tape comprises a layer (26) of lacquer; said graphic signs (9) being printed on said layer (26) of lacquer.

7. The packet of claim 1 wherein said label (7) comprises a portion (36) of sheet material; said portion (8) of magnetic tape being applied to said portion (36) of sheet material.

8. The packet of claim 7 wherein said graphic signs (9) are printed on said portion (36) of sheet material.

9. A method of producing a packet (2) of cigarettes having a parallelepiped shape, the method comprising the first steps of folding and assembling to one another a number of sheet material components **(3*a*, 16, 20) to define an inner wrapping (3) housing a group of cigarettes and an outer package (4); and a second step of supplying and applying a label (7) to at least one of said components (3*a*, 16, 20), so that the label (7) is visible on the outside of the said packet (2); the packet (2) having two lateral major walls and two lateral minor walls and comprising a top portion, which is openable for the extraction of the cigarettes, and a bottom portion for the storage of the cigarettes; said label (7) being at least partly defined by a portion (8) of magnetic data recording tape; and the method being characterized by comprising the first step of printing graphic signs (9) on said label (7) during or after said second step; the label (7) being applied to one of said lateral walls of said bottom portion of the packet (2)** in order to be completely arranged on only one lateral wall of said bottom portion.

10. The method of claim 9 wherein said label (7) is applied to said component **(3*a*, 16, 20)** before said first steps are performed.

11. The method of claim 9 wherein said label (7) is applied to said component **(3*a*, 16, 20)** after said first steps are performed.

12. A packet for the storage of cigarettes, comprising:

a number of sheet material packing components **(3*a*, 16, 20) folded and assembled to one another to define an inner wrapping (3) housing a group of cigarettes and an outer package (4)**;

two lateral major walls and two lateral minor walls, a top wall and a bottom wall defining a parallelepiped shape;

a top portion, which is openable for the extraction of the cigarettes, the top portion defined by four top sidewalls and the top wall, the four sidewalls each being a portion of the lateral walls;

a bottom portion for the storage of the cigarettes, the bottom portion defined by four bottom sidewalls and the bottom wall, the four bottom sidewalls each being a portion of the lateral walls;

a label (7) applied to at least one of said sheet material packing components **(3*a*, 16, 20) and being visible on the outside of the packet (2)**;

wherein at least one portion of the label (7) is defined by a portion (8) of magnetic data recording tape, the label (7) has printed graphic signs (9); and a group of cigarettes housed within the packet.

13. The cigarette packet of claim 12 wherein the label is applied to one of the bottom sidewalls in order to be completely arranged on only one bottom sidewall.

* * * * *

UNITED STATES PATENT AND TRADEMARK OFFICE

CERTIFICATE OF CORRECTION

PATENT NO. : 6,669,015 B2
DATED : December 30, 2003
INVENTOR(S) : Draghetti et al.

It is certified that error appears in the above-identified patent and that said Letters Patent is hereby corrected as shown below:

Title page,
Item [57], ABSTRACT, "printed," should be -- printed --

Column 5,
Line 5, "claim 1 said label" should be -- claim 1 wherein said label --

Signed and Sealed this

Fourth Day of May, 2004

JON W. DUDAS
*Acting Director of the United States Patent and Trademark Office*